United States Patent [19]

Kanai

[11] Patent Number: 4,492,252

[45] Date of Patent: Jan. 8, 1985

[54] REVERSIBLE VALVE FOR REVERSIBLE REFRIGERATION CYCLE

[75] Inventor: Yoshikazu Kanai, Sayama, Japan

[73] Assignee: Kabushiki Kaisha Saginomiya Seisakusho, Tokyo, Japan

[21] Appl. No.: 354,492

[22] Filed: Mar. 3, 1982

[30] Foreign Application Priority Data

Mar. 18, 1981 [JP] Japan ..... 56-36788[U]

[51] Int. Cl.[3] ..... F25B 13/00; E03B 3/00

[52] U.S. Cl. ..... 137/625.43; 92/194; 92/240; 92/243

[58] Field of Search ..... 137/625.43, 625.29; 92/193, 194, 240, 243

[56] References Cited

U.S. PATENT DOCUMENTS

| | | | |
|---|---|---|---|
| 2,927,830 | 3/1960 | Workman | 92/194 |
| 2,969,091 | 1/1961 | Wolff | 137/625.43 |
| 2,991,631 | 7/1961 | Ray | 137/625.43 X |
| 3,055,394 | 9/1962 | Dilliner | 137/625.29 |
| 3,181,567 | 5/1965 | Deutsch et al. | 137/625.43 |
| 3,894,561 | 7/1975 | Thornberry | 137/625.29 |
| 3,902,405 | 9/1975 | Costarella et al. | 92/243 |
| 3,994,208 | 11/1976 | Boyer | 92/240 |
| 4,248,058 | 2/1981 | Bauer et al. | 137/625.43 X |

*Primary Examiner*—Alan Cohan
*Assistant Examiner*—John A. Rivell

[57] ABSTRACT

A reversible valve for reversible refrigeration cycle. The valve means used therein is a hollow cylindrical body longitudinally extending within the valve body. It has a pair of inclined annular walls projecting from around the hollow cylindrical body to define an annular chamber therearound in cooperation with the valve body such that the annular chamber communicates the suction tube selectively with either one of said pair of tubes.

7 Claims, 18 Drawing Figures

REVERSIBLE VALVE FOR REVERSIBLE REFRIGERATION CYCLE

BACKGROUND OF THE INVENTION

The present invention relates to an improvement in a four-way valve for a reversible refrigeration cycle which has a comparatively small pressure receiving side constantly subjected to a high fluid pressure and a comparatively large pressure receiving side selectively subjected to a high fluid pressure and a low fluid pressure by switching action of a solenoid operated pilot valve, and constructed such that its piston or plunger moves due to the difference in effective cross sectional area between the two pressure receiving sides when a high fluid pressure is communicated to the larger pressure receiving side and due to the pressure differential when a low fluid pressure is communicated to the larger pressure receiving side.

A prior art four-way valve of the type described and actuated by a three-way solenoid operated pilot valve will be briefly described.

Figure 1:
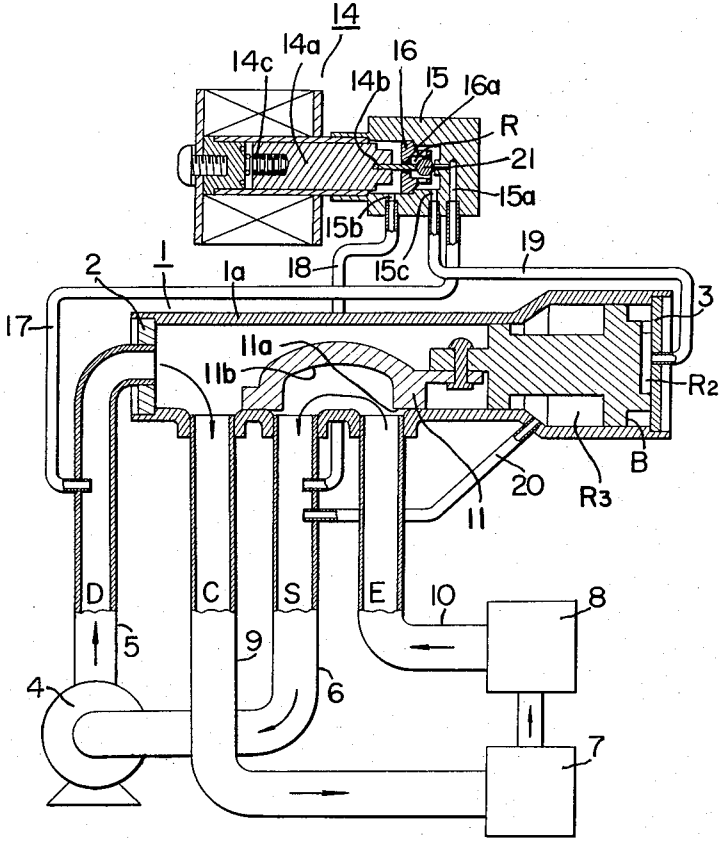
FIG. 1 Prior Art

Referring to FIG. 1 of the drawings, the prior art four-way valve has a generally cylindrical valve body 1 which is made up of a first section 1*a* and a second section 1*b* larger in diameter than the first section 1*a*. Plugs 2, 3 are securely fitted by welding to the open ends of the valve body 1, respectively.

A delivery tube 5 is connected with the plug 2 to provide fluid communication between a compressor 4 and the valve body 1. A suction tube 6 is connected with the peripheral wall of the valve body 1 and leads therefrom to the compressor 4.

A tube 9 is connected with the peripheral wall of the valve body 1 to extend therefrom to a heat exchanger 7 which selectively serves as a condenser and an evaporator. Likewise, but on the opposite side to the tube 9 with respect to the tube 6, a tube 10 is connected with the peripheral wall of the casing 1 to extend therefrom to a second heat exchanger 8 which functions in the same manner as the first heat exchanger 7.

A valve member 11 is located inside the valve body 1. The valve member 11 is formed with a recess 11*b* in its sliding surface 11*a* which is calibrated such that the suction tube 6 is communicatable selectively with the tubes 9, 10 depending on the position of the valve member 11.

Valve member 11 is rigidly carried on a plunger 12 as by a rivet 13 or by brazing. The plunger 12 has a pressure receiving portion or piston A which slides within the small diameter casing section 1*a* and a second pressure receiving portion or piston B which is larger in diameter than the portion A and slides in the larger diameter casing section 1*b*. As shown, the rigid connection of the valve member 11 with the plunger 12 is located adjacent to the smaller diameter pressure receiving portion A.

The piston A of the plunger 12 defines a chamber $R_1$ in cooperation with the casing 1 while the piston B defines chambers $R_2$, $R_3$ on opposite sides thereof in cooperation with the casing 1.

A solenoid operated pilot valve 14 includes a switching mechanism having a body 15. The body 15 is formed with a high pressure induction passageway 15*a*, a low pressure discharge passageway 15*b* and a common passageway 15*c*. A valve seat 16 having a passageway 16*a* therethrough is threaded into the body 15 to define a chamber R in cooperation with the body 15. Thus, the chamber R has fluid communication with the high pressure induction passageway 15*a*, low pressure discharge passageway 15*b* via the passageway 16*a* and the common passageway 15*c*. The passageway 15*a* leads to the delivery tube 5 through a bleed tube 17, the passageway 15*b* to the suction tube 6 via a low pressure discharge tube 18, and the passageway 15*c* to the chamber $R_2$ in the casing 1 via a pilot tube 19.

The chamber $R_3$ between the larger diameter casing section 1*b* and the larger diameter piston B of the plunger 12 is communicated with the suction tube 6 by a low pressure induction tube 20.

The pilot valve 14 has a plunger 14*a* from which a rod 14*b* extends throughout the passageway 16*a* of the valve seat 16. A valve member in the form of a ball 21 is received in the chamber R and actuated by the rod 14*b* to selectively communicate the passageways 15*a*, 15*b* with the passageway 15*c* as will be described.

The four-way valve constructed as above will be operated as follows. Let it be assumed that the heat exchanger 7 is located outside a desired enclosure such as a room and the heat exchanger 8 inside the enclosure.

In a cooler mode, all the components of the four-way valve and its associated pilot valve are positioned as shown in FIG. 1. The solenoid coil of the pilot valve 14 remains deenergized so that the plunger 14*a* is held by a coil spring 14*c* in a rightward position as viewed in FIG. 1. The rod 14*b* urges the ball 21 against the body 15 to block the passageway 15*a* overcoming the high pressure communicated to the passageway 15*a*. The passageway 16*a* in the valve seat 16 is communicated to the chamber $R_2$ in the casing 1 via the common passageway 15*c* and pilot tube 19.

Under this condition, a low fluid pressure is admitted in both the chambers $R_2$, $R_3$ and acts equally on the opposite sides of the larger diameter piston B. On the other hand, a high fluid pressure is admitted in the chamber $R_1$ defined by the smaller diameter piston A. Due to this pressure differential, the plunger 12 is maintained in its rightward position as viewed in the drawing.

Moved rightwardly together with the plunger 12, the valve member 11 causes the delivery tube 5 into communication with the outdoor heat exchanger 7 via the tube 9 while causing the indoor heat exchanger 8 into communication with the suction tube 6 via the tube 10. In this situation, fluid, i.e., refrigerant is allowed to circulate as indicated by arrows in FIG. 1 so that the outdoor heat exchanger 7 functions as a condenser and the indoor heat exchanger 8 as an evaporator.

Figure 2:
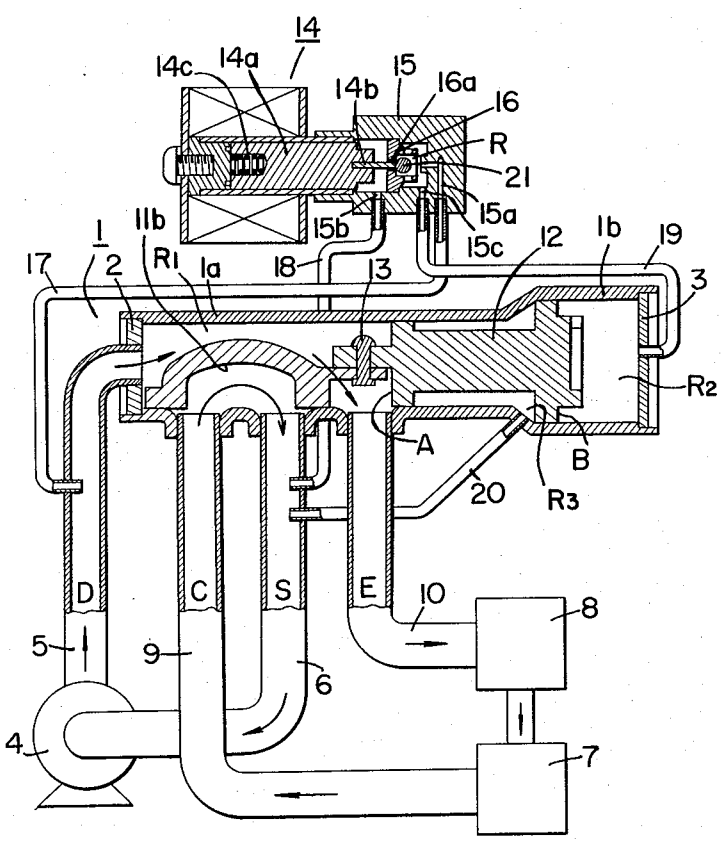
FIG. 2 Prior Art
Figure 3:
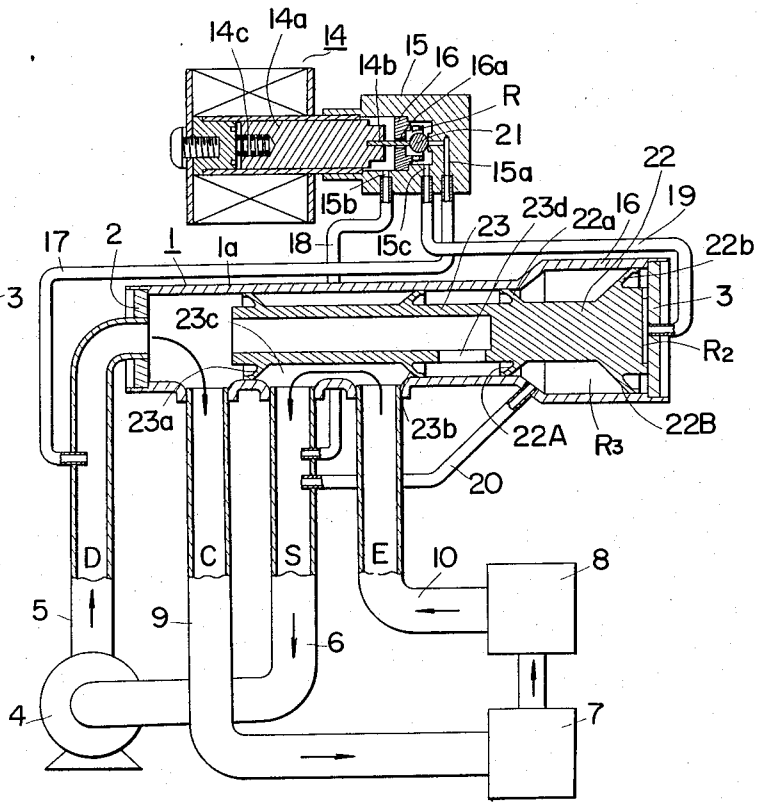
Figure 4:
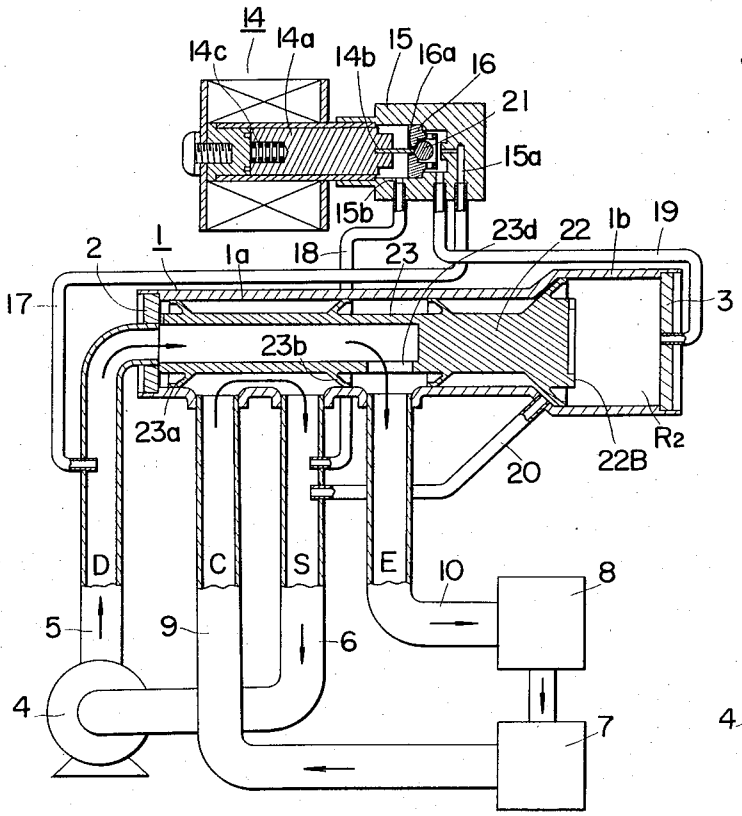
Figure 5:
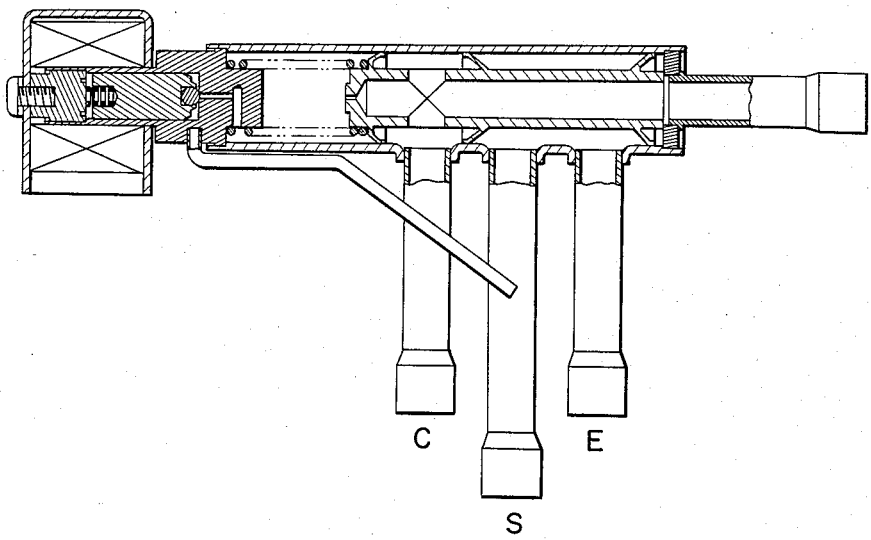
Figure 6:
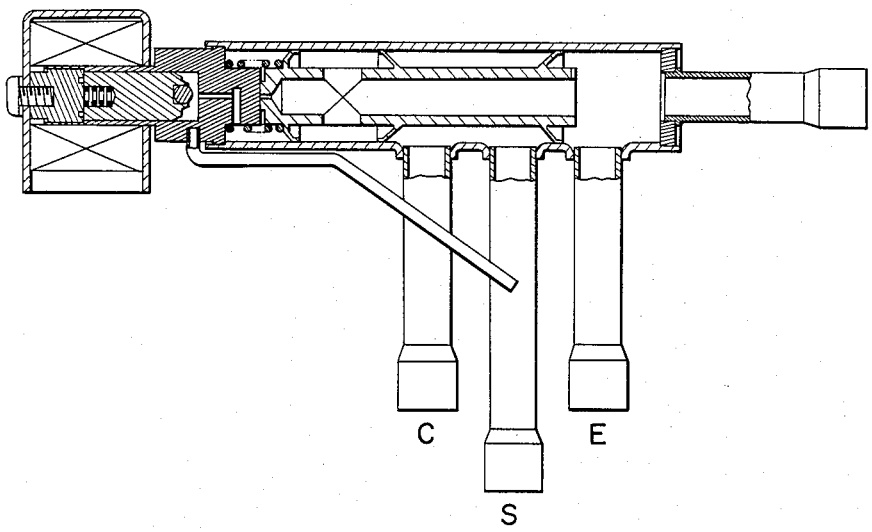
Figure 7:
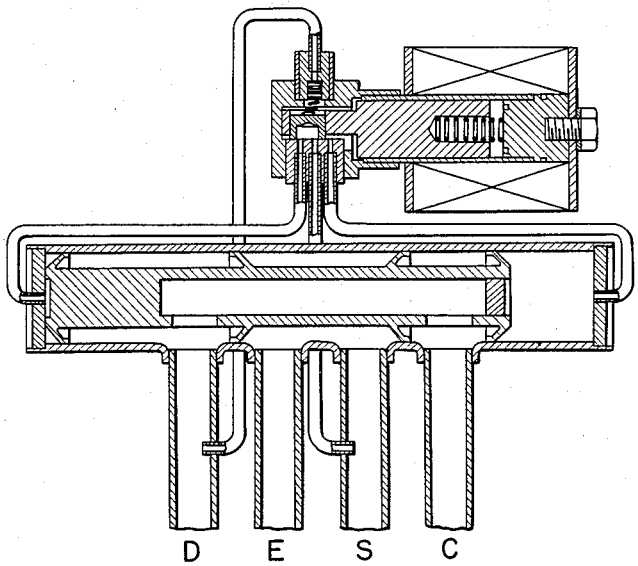
Figure 8:
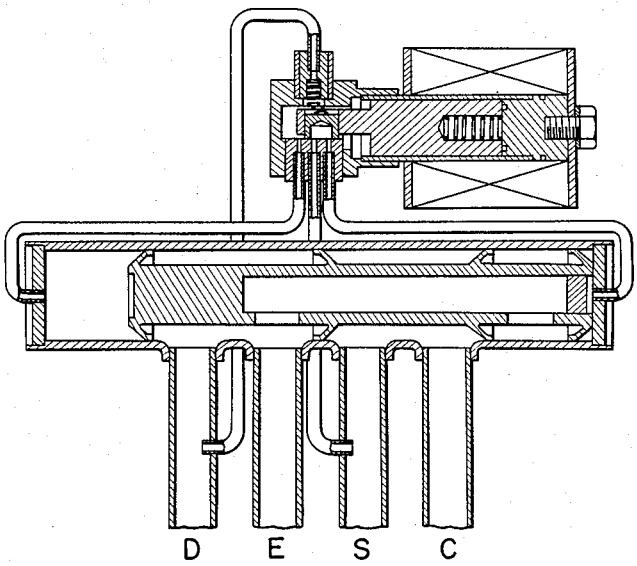

When the coil of the pilot valve 14 is energized to switch the operation mode of the system from the cooler mode to a heater mode, the plunger 14*a* is attracted to the left accompanied by the rod 14*b* as illustrated in FIG. 2. Then, the ball 21 is urged clear of the body 15 into contact with the seat 16 by the high pressure in the passageway 15*a*, whereby the passageway 15*a* is opened and the passageway 16*a* closed. The high pressure is therefore admitted in the chamber $R_2$ of the casing 1 via the pilot tube 19 so as to act on the larger diameter piston B of the plunger 12.

The pressure acting on the piston B is as high as the pressure acting on the other piston A. However, due to the difference in effective cross sectional area between the pistons A and B, the plunger 12 is moved to the left from the position shown in FIG. 1. The valve member 11 moving together with the plunger 12 reaches a posiment of the valve spool for switching the fluid circulation path, the following modification to the pressure receiving portions may be resorted to.

Figure 9:
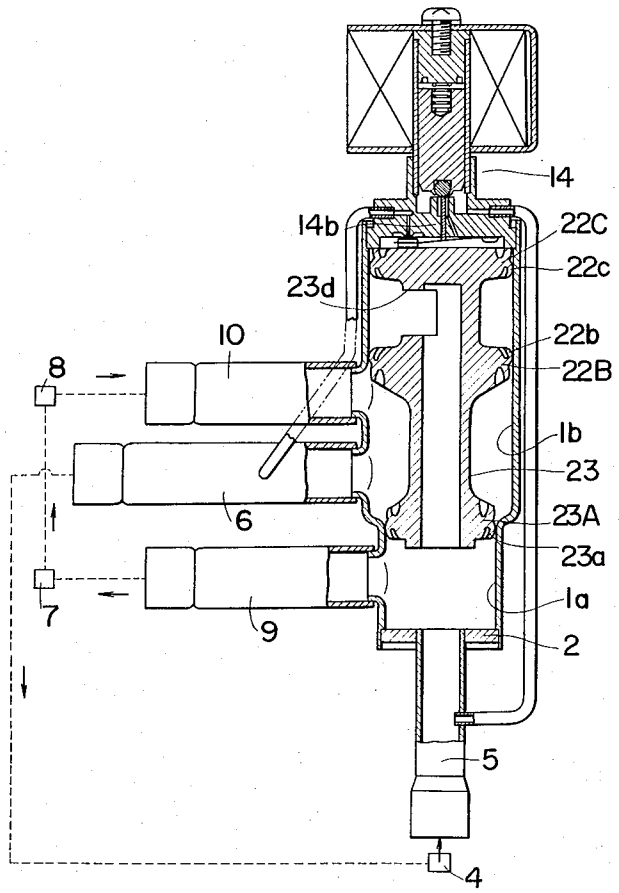
Figure 10:
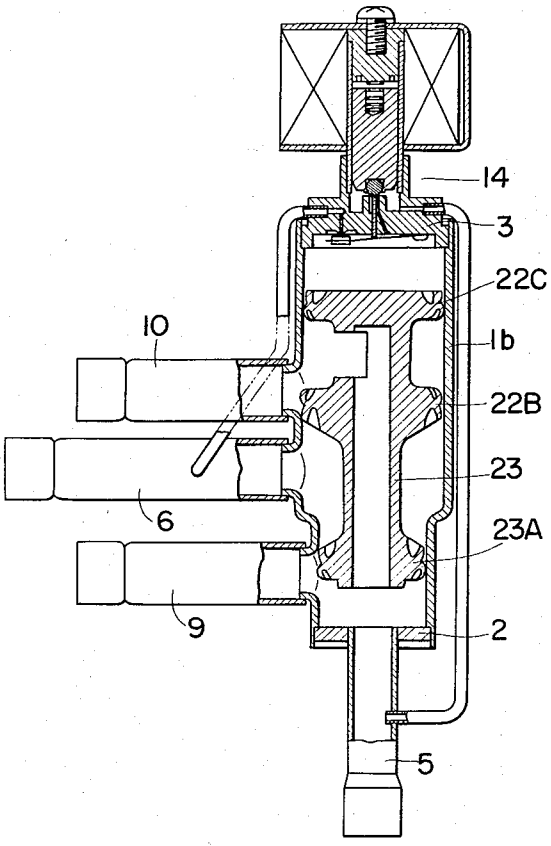
Figure 11:
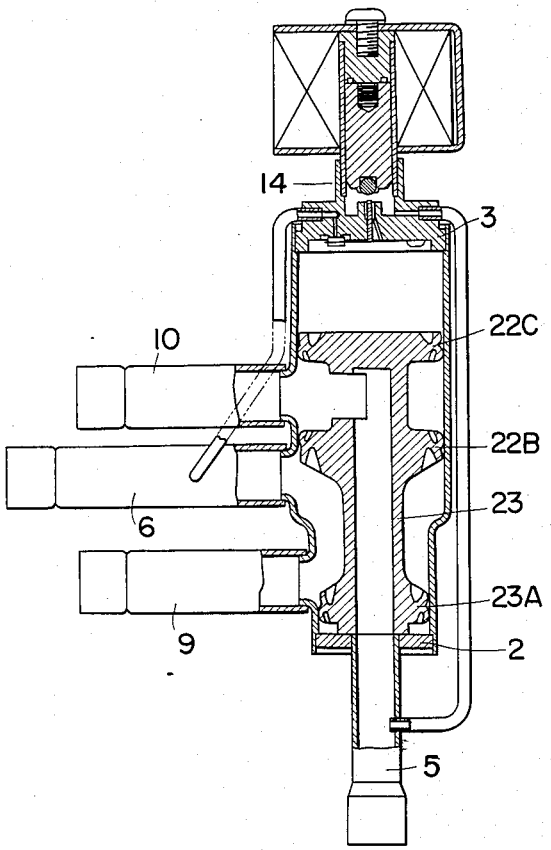
Figure 13:
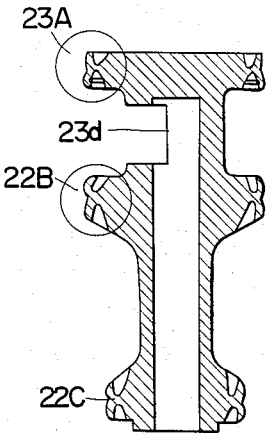
Figure 12A:
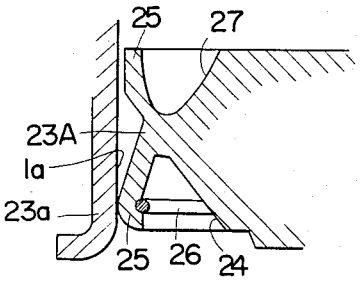
Figure 12B:
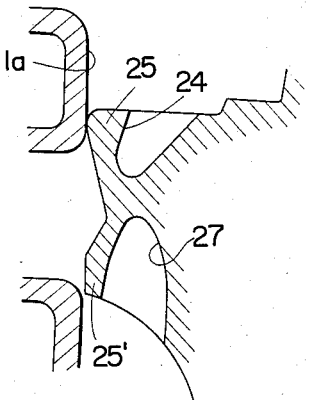
Figure 12C:
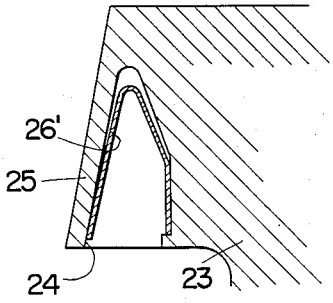
Figure 12D:
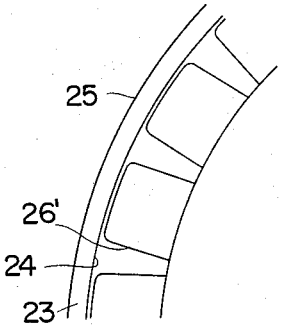

Referring to FIGS. 9–11, a four-way valve embodying the present invention has a generally cylindrical casing of metal which is generally designated by the reference numeral 1. The casing 1 comprises a first section 1*a* and a second section 1*b* which is larger in diameter than the first 1*a*. Plugs 2, 3 are securely fitted by welding in the opposite open ends of the casing 1, respectively. A delivery tube 5 is connected with the plug 2 to extend therefrom to the delivery side of a compressor 4. A suction tube 6 is connected with the peripheral wall of the casing 1 and leads therefrom to the suction side of the compressor 4. A tube 9 leads from the casing 1 to a heat exchanger 7 which selectively serves as a condenser and an evaporator. Likewise, but on the opposite side to the tube 9 with respect to the suction tube 6, a tube 10 leads from the casing 1 to a second heat exchanger 8 which functions in the same way as the first heat exchanger 7. A valve spool 23 formed of resin is slidably received in the casing 1. The valve spool 23 includes a pressure receiving portion 23A located at one end of the valve spool and formed with an annular tongue 22*c* therearound which is slidably engaged with the inner wall of the smaller diameter casing section 1*a*. The valve spool 23 also includes a second pressure receiving portion 22B located at an axially intermediate position of the valve spool and formed with an annular tongue 22*b* therearound which is slidably engaged with the inner wall of the larger diameter casing section 1*b*. Further included in the valve spool 23 is a third pressure receiving portion 22C located at the other end of the valve spool 23 and formed with an annular tongue therearound 22*c* which is slidably engaged with the larger diameter casing section 1*b* as the second pressure receiving portion 22B. Examples of the tongues 23*a*, 22*b*, 22*c* on the valve spool 23 are illustrated in FIGS. 12A and 12B. As shown in FIGS. 12A to 12D, each tongue is formed with an annular recess or groove 24 which is open at the high pressure receiving side of the tongue, so that a flap 25 formed around the groove 24 is pressed against the inner wall of the casing 1 by a pressurized fluid. If necessary, a wire ring 26 may be fitted in the groove 24 for reinforcement as shown in FIG. 12A, or a leaf spring ring 26' which is bent into a substantially U-shaped configuration to fit in the groove as shown in FIGS. 12*c* and 12D which is a plan view thereof may be employed for the same purpose. Each pressure receiving portion 22A–22C of the valve spool 23 is recessed as at 27 on its other or low pressure receiving surface to form a flap 25' whose outside diameter is equal to or slightly smaller than the inside diameter of the casing 1. When subjected to a fluid pressure, the annular flap 25' will intimately engage with the inner wall of the casing 1 to minimize mutual communication of high pressure and low pressure fluids in the course of a switching movement of the valve spool 23.

The valve spool 23 is a hollow cylindrical member which is open at the end of the smaller pressure receiving portion 23A. An opening 23*d* is formed through the peripheral wall of the valve spool 23 between the neighboring larger diameter pressure receiving portions 22B and 22C.

The annular tongues 23*a*, 22*b*, and 22*c* on the valve spool 23 are located so that they will communicate the tubes 6, 10 to each other in a first position of the valve spool 11 shown in FIG. 9, but communicate the tubes 6, 9 to each other in a second position shown in FIG. 11 in which the valve spool 23 has moved downward from the position of FIG. 1.

By opening the annular recesses or grooves in the high and low pressure receiving surfaces of the two large diameter pressure receiving portions and the one small diameter pressure receiving position and further providing, if necessary reinforcement rings within the recesses on the high pressure side such that the annular tongues are pressed against the inner wall of the valve body, excellent sealing effect is obtained even if the spool valve axially rotates during the switching operation.

Figure 14:
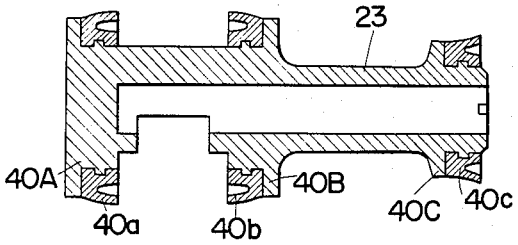

Referring to FIG. 14, a valve 23 is formed of metal and provided with successive pressure receiving portions 40A, 40B, 40C. Annular pieces 40*a*, 40*b*, and 40*c* formed of fluoric resin such as Teflon are attached to the respective pressure receiving portions 40A, 40B, and 40C as illustrated to constitute annular valve tongues.

The annular tongue 40*a* in the pressure receiving portion 40A slides smoothly on the inner wall of a larger diameter casing section (not shown) due to a very small coefficient of friction of Teflon (about 0.05). The other annular tongues, 40*c* not only slide smoothly on the casing wall but attain a mechanical strength large enough for them to be prevented from being turned over during movement.

Figure 15:
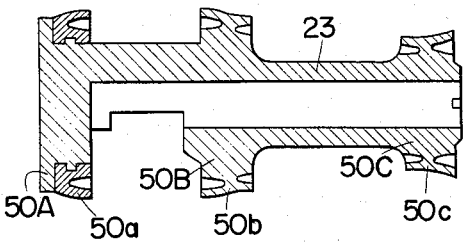

Referring to FIG. 15, a valve body 23 according to an alternative embodiment of the invention has successive pressure receiving portions 50A, 50B and 50C formed of polyamide resin such as Nylon and annular tongues 50B, 50C in the pressure receiving portions 50B, 50C also formed of polyamide resin. An annular tongue 50*a* in the pressure receiving portion 50A at the end of the valve body 50 is formed of fluoric resin such as Teflon.

The annular tongue 50*a* slides smoothly on and intimately engages with the casing inner wall due to the very small coefficient of friction of Teflon (which softens more easily than Nylon whose coefficient of friction is about 0.2, for a common high temperature). The annular tongues 50*b*, 50*c* on the other hand has a sufficient mechanical strength against turning-over as well as smooth sliding contact with the casing inner wall, which results from significant wear resistance and tensile strength of Nylon. Incidentally, Nylon has a tensile strength of about 530–780 $kg/cm^2$ while Teflon is about 140–210 $kg/cm^2$ in tensile strength.

For reinforcement purpose, a ring, again, may be fitted in the annular recess in the high pressure receiving surface of the annular tongue in the larger pressure receiving portion at the end of the valve body in any one of the embodiments described. In such a case, Teflon will prove effective as a material of said annular tongue in ensuring smooth sliding contact thereof with the casing inner wall against a force which would tend to urge the flap radially outwardly.

Apart from the advantages of the prior art valve, the following additional advantages are achievable with the present invention due to unitary moulding of a valve spool with multiple valving members from resin. The valve can be produced accurately with ease and by a minimum of steps. Despite any change in the temperature of a refrigerant, the valving members remain seated liquid-tight on the inner wall of the casing to avoid leakage of the refrigerant, because of the combined effect of the pressure with which the valving members whose hardness varies in proportion to the temperature change are engaged with the casing and the fluid pressure acting on the valving members inside the casing.

The passage for selective communication of the suction tube with the other tubes is defined by the annular space between a pair of annular valving tongues and the casing. Compared to the conventional recess for such selective communication, the annular space is large enough to reduce the resistance to the flow of a refrigerant and, therefore, to make the casing small in size. Also, any angular movement of the valve spool about its axis does not affect the selective communication among the tubes, unnecessitating an anti-rotation mechanism heretofore employed. As a whole, the valve of the invention is durable and economical.

What is claimed is:

1. A reversible valve for a reversible refrigeration cycle which comprises a valve body having a small diameter section and a large diameter section;

a delivery tube in communication with a compressor and opening into said small diameter section;

a suction tube in communication with said compressor and opening into said small diameter section;

a pair of tubes in communication with two heat exchangers, respectively, and opening into said small diameter section one on each side of the suction tube;

a one-piece valve means for communicating said suction tube selectively with either one of said pair of tubes; and a pilot valve to operate said valve means, said one-piece valve means including a hollow cylindrical body longitudinally extending within the valve body and having a small diameter pressure receiving portion and a large diameter pressure receiving portion in snug sliding engagement with the large diameter section, and a pair of inclined walls projecting from around the hollow cylindrical body to seal against the wall of the valve body small diameter section in snug sliding engagement with the small diameter section to define a closed annular chamber around said hollow cylindrical body in cooperation with said small diameter section such that said closed annular chamber communicates the suction tube selectively with either one of said pair of tubes when said cylindrical body is operated.

2. A reversible valve according to claim 1, wherein said small diameter pressure receiving portion is positioned between the annular chamber and the large diameter pressure receiving portion, said hollow cylindrical body having an opening therein to communicate the delivery tube with the small diameter pressure receiving portion.

3. A reversible valve according to claim 1, wherein said small and large diameter pressure receiving portions are formed with annular grooves therein to define annular flaps in facing relation to high pressure refrigerant.

4. A reversible valve according to claim 3, further including resilient members charged in said annular grooves to snugly fit the flaps within the hollow cylindrical body.

5. A reversible valve according to claim 4, wherein at least one of said inclined walls and said small and large diameter pressure receiving portions is made of material different from the hollow cylindrical body.

6. A reversible valve according to claim 5, wherein said inclined walls, are made of fluoric resin whereas the hollow cylindrical body is made of metal.

7. A reversible valve according to claim 5, wherein either one of small and large diameter pressure receiving portions is made of fluoric resin whereas the other is made of polyamide resin.

* * * * *